US008616518B2

(12) United States Patent
Sladojevic

(10) Patent No.: US 8,616,518 B2
(45) Date of Patent: Dec. 31, 2013

(54) STAIR FORMING METHOD AND APPARATUS

(75) Inventor: Robert Sladojevic, Kent Town (AU)

(73) Assignee: SRB Construction Technologies Pty. Ltd., Kent Town (AU)

( * ) Notice: Subject to any disclaimer, the term of this patent is extended or adjusted under 35 U.S.C. 154(b) by 1029 days.

(21) Appl. No.: 12/514,729

(22) PCT Filed: Oct. 31, 2007

(86) PCT No.: PCT/AU2007/001656
§ 371 (c)(1),
(2), (4) Date: Jun. 17, 2009

(87) PCT Pub. No.: WO2008/058314
PCT Pub. Date: May 22, 2008

(65) Prior Publication Data

US 2009/0266970 A1 Oct. 29, 2009

(30) Foreign Application Priority Data

Nov. 14, 2006 (AU) ..... 2006906336

(51) Int. Cl.
*B28B 7/22* (2006.01)

(52) U.S. Cl.
USPC ..... 249/14

(58) Field of Classification Search
USPC ..... 249/34, 14, 208, 155, 8; 264/249, 261, 264/263; 52/183, 189, 190, 191, 9
See application file for complete search history.

(56) References Cited

U.S. PATENT DOCUMENTS

| | | | | | |
|---|---|---|---|---|---|
| 624,782 | A | * | 5/1899 | Fuchs | 182/1 |
| 1,106,627 | A | * | 8/1914 | Cornelius | 249/14 |
| 1,124,327 | A | * | 1/1915 | Park | 249/14 |
| 1,153,462 | A | * | 9/1915 | Stubblefield | 249/14 |
| 1,173,066 | A | * | 2/1916 | Vandegrift | 249/14 |
| 1,239,462 | A | * | 9/1917 | Clinkunbroomer | 249/14 |
| 1,319,385 | A | * | 10/1919 | Gottschalk | 249/208 |
| 1,538,604 | A | * | 5/1925 | Thrasher et al. | 249/14 |
| 1,747,036 | A | * | 2/1930 | Sullivan | 425/213 |
| 2,353,676 | A | * | 7/1944 | Kogl | 249/14 |
| 2,389,397 | A | * | 11/1945 | Zimmerman | 249/14 |
| 2,548,703 | A | * | 4/1951 | Cline | 249/14 |
| 2,592,578 | A | * | 4/1952 | Kogl | 249/14 |
| 2,610,380 | A | | 9/1952 | Pollman | |
| 2,702,931 | A | * | 3/1955 | Johnson | 249/14 |
| 3,284,042 | A | | 11/1966 | Ingalise | |
| 3,780,976 | A | * | 12/1973 | Messier | 249/14 |
| 3,823,910 | A | * | 7/1974 | Crozier | 249/14 |

(Continued)

FOREIGN PATENT DOCUMENTS

| | | | |
|---|---|---|---|
| DE | 3518200 | C1 * | 8/1986 |
| DE | 4206322 | A1 * | 9/1993 |
| JP | 05287900 | A * | 11/1993 |

*Primary Examiner* — Joshua Rodden
(74) *Attorney, Agent, or Firm* — Sughrue Mion, PLLC

(57) ABSTRACT

A stairway forming system includes a plurality of stacked, elongate stair riser form carriers, the carriers being longitudinally displaceable relative to one another. An anchoring unit anchors at least a lowermost riser form carrier in position relative to a substrate. A positioning assembly is attached to at least one of the riser form carriers and cooperates with the remaining riser form carriers for displacing the carriers in unison relative to one other to adopt a staggered operative configuration approximating an angle of the stairway to be formed.

14 Claims, 4 Drawing Sheets

(56) References Cited

U.S. PATENT DOCUMENTS

| | | | | |
|---|---|---|---|---|
| 3,902,948 | A * | 9/1975 | Morros | 156/222 |
| 4,444,374 | A * | 4/1984 | Gramstad | 249/14 |
| 5,133,530 | A * | 7/1992 | Thoresen | 249/14 |
| 6,247,677 | B1 * | 6/2001 | Vinet et al. | 249/189 |
| 7,185,875 | B1 | 3/2007 | Jarrett | |
| 2009/0266969 | A1 * | 10/2009 | Costello et al. | 249/14 |

* cited by examiner

STAIR FORMING METHOD AND APPARATUS

CROSS-REFERENCE TO RELATED APPLICATIONS

The present application claims priority from Australian Provisional Patent Application No. 2006906336 filed on 14 Nov. 2007, the contents of which are incorporated herein by reference.

FIELD OF THE INVENTION

This invention relates, generally, to the formation of a stairway and, more particularly, to a stairway forming system and to a method of forming a stairway.

BACKGROUND TO THE INVENTION

In the construction of multi-storey buildings one of the most time consuming and difficult construction jobs is the manufacture of stairs between floors. Stair forming systems generally rely on skilled tradespeople to construct formwork before concrete stairs can be poured. It will be appreciated that, in the fabrication of a stairway, the angle of the stairway has to be accurately set and the depth of the treads and the height of the risers of the stairs has to be accurately maintained. This necessitates very careful placing of formwork to form the stairway.

The use of skilled tradespeople increases the cost of the project. Often, where the skilled tradesperson is an independent contractor, there may be delays due to the amount of work the tradesperson has at that time. In certain circumstances, such delays to a project can render the project manager liable for penalties.

SUMMARY OF THE INVENTION

According to a first aspect of the invention, there is provided a stairway forming system which includes

- a plurality of stacked, elongate stair riser form carriers, the carriers being longitudinally displaceable relative to one another;
- an anchoring unit for anchoring at least a lowermost riser form carrier in position relative to a substrate; and
- a positioning assembly which is attached to at least one of the riser form carriers and which cooperates with the remaining riser form carriers for displacing the carriers in unison relative to one another to adopt a staggered operative configuration approximating an angle of the stairway to be formed.

The system may include a riser form carried at a distal end of each carrier, the riser forms being in alignment with each other when the positioning assembly is in a first, rest configuration and the riser forms being in the staggered operative configuration when the positioning assembly is displaced to an operative position.

Further, the system may include a movement limiting arrangement carried by at least one of the carriers for limiting the movement of the positioning assembly for limiting travel of the positioning assembly when it is displaced to its operative position. Preferably, the movement limiting arrangement is adjustable for adjusting a limit of travel of positioning assembly to enable stairways of differing angles to be formed.

The positioning assembly may include an engaging formation and each of the remaining carriers may include an engageable element which is engaged by the engaging formation of the positioning assembly.

The positioning assembly may be pivotally attached to the at least one carrier, the at least one carrier being the lowermost carrier and the engaging formation of the positioning assembly engaging the engageable elements of the remaining carriers stacked on the lowermost carrier.

The anchoring unit may include a clamping assembly for clamping at least two of the carriers together to retain the structural integrity of the carriers when the carriers are in their operative configuration. Further, the anchoring unit may include a levelling facility for levelling the carriers with respect to the substrate.

The anchoring unit may include a retaining arrangement for retaining at least the lowermost riser form carrier in position.

The system may include a lower formwork assembly for fabricating a lower portion of the stairway, the lower formwork assembly being mounted in position beneath the carriers when the carriers are in their operative configuration.

According to a second aspect of the invention, there is provided a method of forming a stairway, the method including attaching a stack of elongate stair riser form carriers to a substrate, a stair riser form being attached to a distal end of each carrier;

arranging the carriers on the substrate so that, initially all the riser forms are in a first, inoperative configuration relative to one another;

displacing the carriers relative to one another so that the riser forms are in a second, operative configuration relative to one another with the riser forms being in a step shaped, staggered configuration relative to one another; and clamping at least two of the carriers together after the carriers have been displaced to retain the riser forms in their operative configuration.

The method may include mounting at least the lowermost riser in an anchoring unit and retaining the lowermost riser in position relative to the anchoring unit. Further, the method may include using the anchoring unit to clamp the at least two carriers together. Preferably, the method includes levelling the anchoring unit relative to the substrate.

The method may include setting a limit of travel of the carriers from their inoperative configuration to their operative configuration. Additionally, the method may include adjusting the limit of travel of the carriers for adjusting an angle of the stagger.

The method may include erecting formwork beneath the riser forms when the carriers are in their operative configuration. The method may include erecting the formwork on adjustable supports and adjusting the supports to adjust an angle at which the formwork is arranged relative to the riser forms.

BRIEF DESCRIPTION OF THE DRAWINGS

An embodiment of the invention is now described by way of example with reference to the accompanying drawings in which.

DETAILED DESCRIPTION OF EXEMPLARY EMBODIMENT

Figure 1:
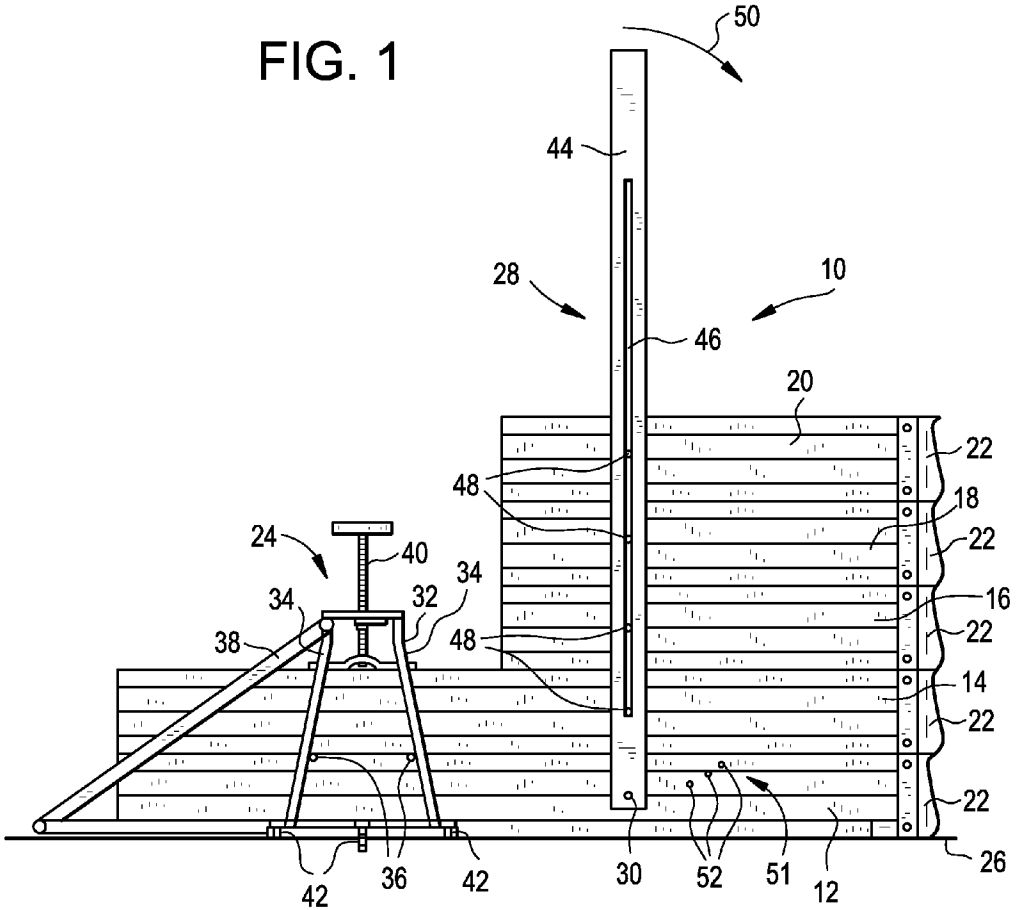
FIG. 1 shows a side view of an embodiment of a stair forming system with a positioning element of the system in an initial position.

In the drawings, reference numeral 10 generally designates a stairway forming system in accordance with an embodiment of the invention. The system 10 includes a plurality of stacked, elongate stair riser form carriers 12, 14, 16, 18 and 20. While five carriers 12, 14, 16, 18 and 20 have been shown in this illustration, it will be appreciated that there will be an equal number of carriers as stairs to be formed in the stairway. Each carrier 12, 14, 16, 18 and 20 carries a stair riser form 22 on its leading end.

The system 10 includes an anchoring unit 24 for anchoring at least the lowermost riser form carrier 12 in position relative to a substrate 26. The substrate 26 could, for example, be a floor of a building from which the stairway is to extend.

The system 10 further includes a positioning assembly 28. The positioning assembly 28 is pivotally connected by a pivot pin 30 to the lowermost riser form carrier 12. The positioning assembly 28 cooperates with the remaining riser form carriers 14, 16, 18 and 20 for displacing the carriers 14, 16, 18 and 20 in unison relative to one another from the position shown in FIG. 1 of the drawings to an operative, staggered configuration approximating an angle of the stairway to be formed, as shown in FIG. 2 of the drawings.

Figure 2:
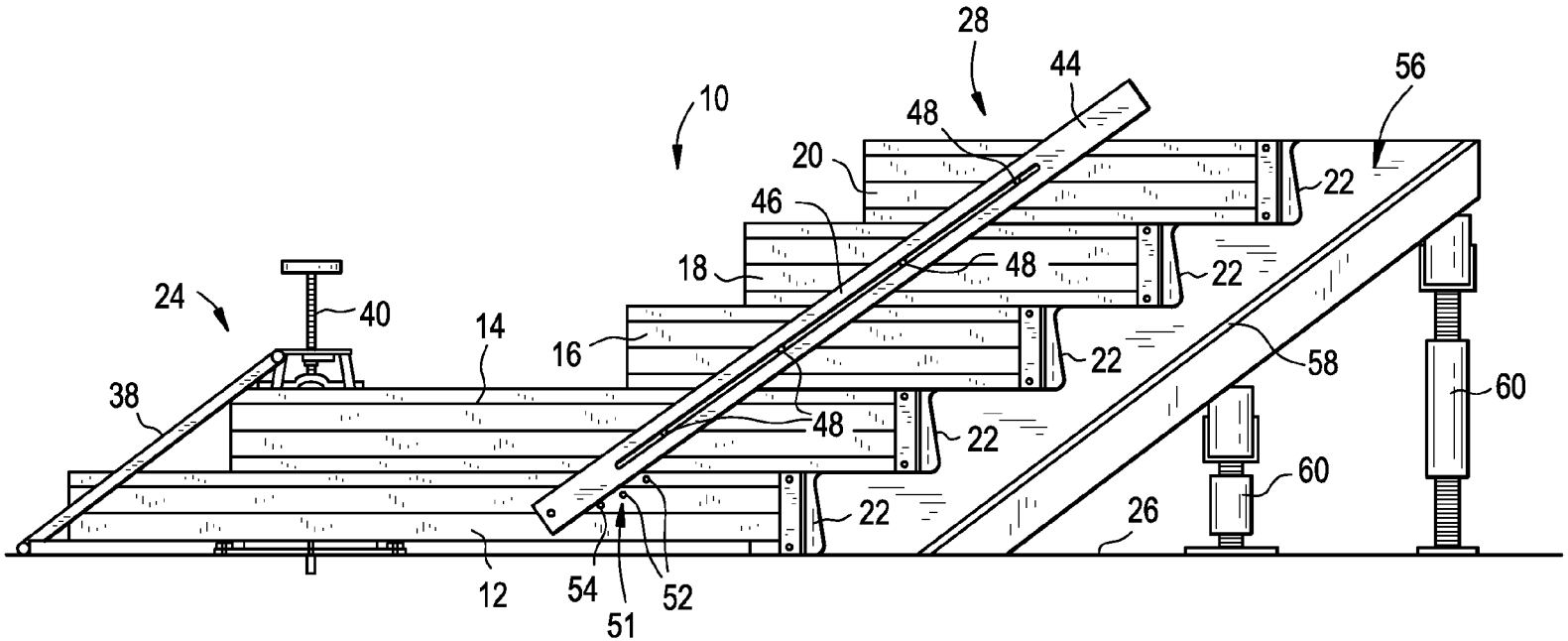
FIG. 2 shows a side view of the system of FIG. 1 with the positioning element moved to a second, operative position to govern an angle of a stairway to be formed.

As illustrated in FIG. 1 of the drawings, when the riser form carriers 12, 14, 16, 18 and 20 are in their inoperative configuration, as shown in FIG. 1 of the drawings, the risers 22 are arranged in vertical alignment.

The anchoring unit 24 comprises a support frame 32. The support frame 32 has a pair of opposed limbs 34 on each side of the carrier 12. The carrier 12 has protrusions 36 protruding from its sides which engage the limbs 34 of the support frame 32 for restraining the carrier 12 against horizontal movement relative to the anchoring unit 24.

The anchoring unit 24 further includes a support post 38 which retains the support frame 32 in position. The support frame 32 supports a clamp 40. The clamp 40 clamps the carrier 14 to the carrier 12, at least when the carriers 12, 14, 16, 18 and 20 are in their operative configuration for retaining the carriers 12, 14, 16, 18 and 20 in their operative, staggered configuration.

The support frame 32 includes a levelling facility comprising levelling elements 42 for levelling the support frame 32 relative to the substrate 26.

The positioning assembly 28 comprises a lever 44. The lever 44 is pivotally mounted to the lower most carrier 12 via the pivot pin 30. The lever 44 defines an engaging formation in the form of a longitudinally extending, axial slot 46. Each of the remaining carriers 14, 16, 18 and 20 carriers an engageable element in the form of a laterally extending pin 48. The pins 48 are received in the slot 46 so that, when the lever is rotated in the direction of arrow 50, the carriers 14, 16, 18 and 20 are displaced relative to the carrier 12 to adopt the staggered, operative configuration shown in FIG. 2 of the drawings.

The system 10 includes a movement limiting arrangement 51. The movement limiting arrangement 51 comprises a plurality of apertures 52 arranged in the lowermost carrier 12. The apertures 52 of the movement limiting arrangement 51 are offset with respect to each other. A pin 54 (FIG. 2) is received in one of the apertures 52 to limit the movement of the lever 44 in the direction of arrow 50. By placing the pin 54 in other of the apertures 52, the angle of the stagger of the carriers 12, 14, 16, 18 and 20 and, hence, the stairway to be formed, can be adjusted.

Referring to FIG. 2 of the drawings, the system 10 further includes a lower formwork assembly 56. The lower formwork assembly 56 comprises formwork 58 supported on struts 60. The lower formwork 58 forms a lower surface of a stairway that is cast using the system 10. As illustrated, the struts 60 are adjustable. Thus, by adjusting the struts 60 the angle of the lower formwork 58 is adjusted to be parallel to the rest position of the lever 44 when the positioning assembly 28 is in its operative configuration.

Figure 3:
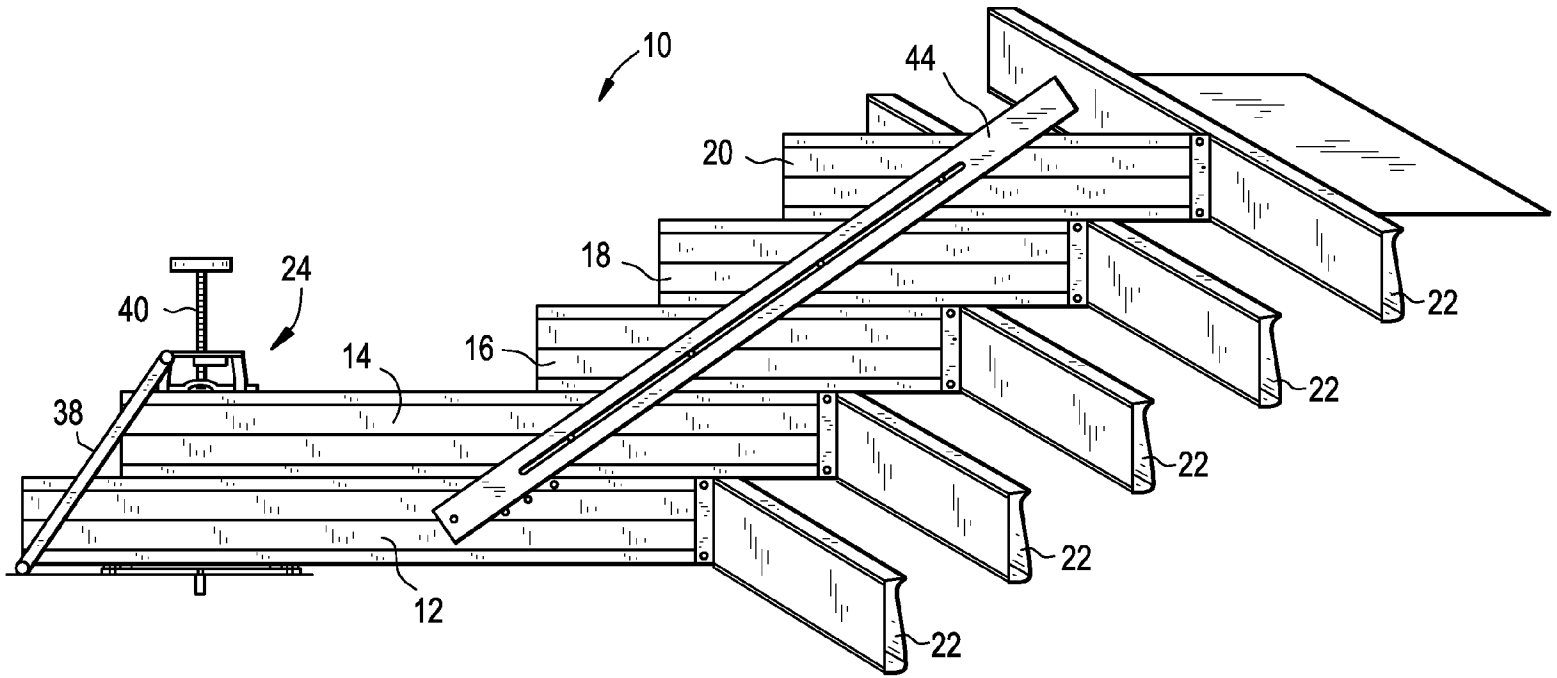
FIG. 3 shows a schematic, part perspective view of the system with the positioning element in its operative position.

It is to be noted that, in FIG. 3 of the drawings, side shuttering and top shuttering has been omitted for the sake of clarity.

Figure 4B:
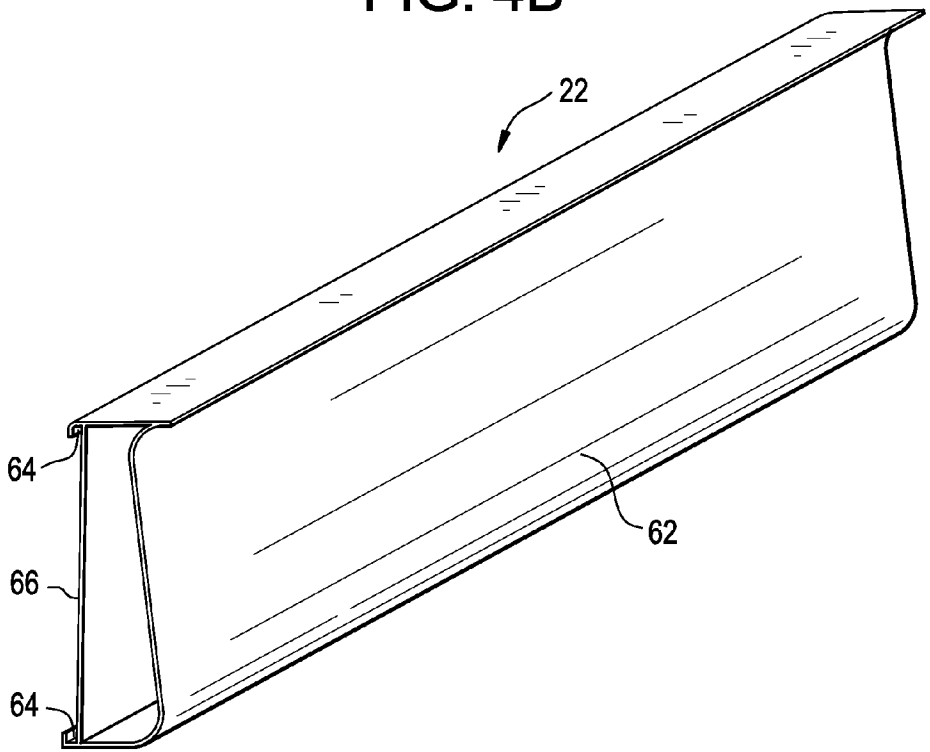
FIG. 4B shows a perspective view of the riser form.
Figure 4A:
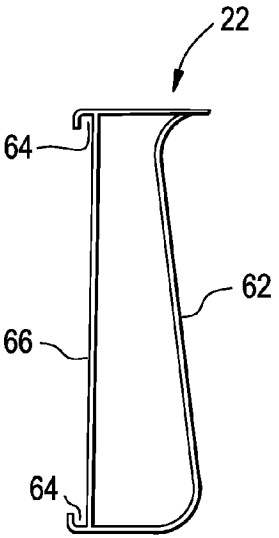
FIG. 4A shows an end view of a riser form for use with the system of FIGS. 1-3.

The carriers 12, 14, 16, 18 and 20 are aluminium extrusions. Similarly, the riser forms 22 are also extrusions of aluminium. It is noted that a face 62 (FIGS. 4A and 4B) of the riser form 22 is shaped to impart the desired profile to the riser portion of the stairway.

The riser form 22 has channel shaped clips 64 on an operative rear portion 66. The clips 64 clip to the leading end of the associated carrier 12, 14, 16, 18 and 20 for clipping the riser form 22 to its associated carrier 12, 14, 16, 18 and 20.

In use, the anchoring unit 24 is mounted on the substrate 26. The first riser form carrier 12 is positioned in the support frame 32 and is retained in position by the protrusions 36 engaging the legs 34 of the support frame 32.

The second riser carrier 14 is slidably mounted on the lowermost carrier 12 and extends through the support frame 32. The carrier 14 is positioned so that its riser 22 is vertically aligned with the riser form 22 of the lowermost carrier 12.

The remaining carriers 16, 18 and 20 are then stacked, one on top of the other, on the carrier 14. The pins 48 of the carriers 14, 16, 18 and 20 are received in the slot 46 of the lever 44 of the positioning assembly 28.

With all the riser forms 22 vertically aligned, the clamp 40 is loosened and the lever 44 is urged in the direction of arrow 50 until the lever 44 comes into abutment with the pin 54 in the relevant aperture 52 of the movement limiting arrangement 51. Once this occurs, the clamp 40 is operated to clamp the carrier 14 to the carrier 12. In so doing, the remaining carriers, due to their pins 48 being received in the slot 46 of the lever 44, are fixed in position relative to the carriers 12 and 14.

The lower formwork 58 is positioned beneath the riser forms 22 and the supports or props 60 are adjusted to ensure that the angle of the lower formwork 58 is the same as the angle of the lever 44.

Side shuttering (not shown) and top shuttering (also not shown) to form a tread portion of each stair of the stairway is fixed in position). Concrete is then poured and is allowed to set following which the side shuttering, top shuttering, lower formwork 58 and the system 10 are removed to reveal the cast stairway.

It is an advantage of the invention that a system 10 is provided which can easily be set up by one person and does not require any trade skills. The depth of the thread portion and the height of the riser portion of each stair of the stairway is automatically determined by the system 10 being positioned in its staggered, operative configuration and does not require any special measurement or careful setting up.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A stairway forming system comprising a plurality of stacked, elongate stair riser form carriers, each riser form carrier having a longitudinal axis, the riser form carriers being displaceable relative to one another in a direction parallel to the longitudinal axes;

an anchoring unit for anchoring at least a lowermost riser form carrier of the plurality of rise form carriers in position relative to a substrate;

a positioning assembly which is attached to at least one of the riser form carriers and which cooperates with the remaining riser form carriers for displacing the riser form carriers, above the lowermost riser form carrier, in unison relative to one another so that the riser form carriers adopt a staggered operative configuration approximating an angle of a stairway to be formed; and a movement limiting arrangement carried by at least one of the riser form carriers for limiting travel of the positioning assembly when it is displaced to an operative position, the movement limiting arrangement being adjustable for adjusting a limit of travel of the positioning assembly to enable stairways of differing angles to be formed.

2. The system of claim 1 which includes a riser form carried at a leading end of the each riser form carrier, the riser form carriers being in alignment with each other when the positioning assembly is in a first, rest configuration and the riser form carriers being in the staggered operative configuration when the positioning assembly is displaced to the operative position.

3. The system of claim 1 in which the positioning assembly includes an engaging formation and in which each of the remaining riser form carriers includes an engageable element which is engaged by the engaging formation of the positioning assembly.

4. The system of claim 3 in which the positioning assembly is pivotally attached to the at least one carrier, the at least one carrier being the lowermost riser form carrier and the engaging formation of the positioning assembly engaging the engageable elements of the remaining riser form carriers stacked on the lowermost riser forte carrier.

5. The system of claim 1 in which the anchoring unit includes a clamping assembly for clamping at least two of the riser form carriers together to retain the structural integrity of the riser form carriers when the riser form carriers are in the staggered operative configuration.

6. The system of claim 1 in which the anchoring unit includes a levelling facility for levelling the riser form carriers with respect to the substrate.

7. The system of claim 1 in which the anchoring unit includes a retaining arrangement for retaining at least the lowermost riser form carrier in position.

8. The system of claim 1 which includes a lower formwork assembly for fabricating a lower portion of the stairway, the lower formwork assembly being mounted in position beneath the riser form carriers when the riser form carriers are in the staggered operative configuration.

9. A method of forming a stairway, the method comprising attaching a stack of elongate stair riser form carriers to a substrate, a stair riser form being attached to a distal end of each carrier riser form;

arranging the riser form carriers on the substrate so that, initially, all the riser form carriers are in a first, inoperative configuration relative to one another;

displacing the riser form carriers, above a lowermost riser form carrier of the plurality of riser form carriers, in unison relative to one another so that the riser form carriers are moved to a second, operative configuration relative to one another in which the riser form carriers adopt a step shaped, staggered configuration relative to one another;

clamping at least two of the riser form carriers together after the riser form carriers have been displaced to retain the riser form carriers in the operative configuration; and limiting travel of the form carriers relative to one another from the inoperative configuration of the riser form carriers to the operative configuration, the limit of travel of the riser form carriers being adjustable to enable stairways of differing angles to be formed.

10. The method of claim 9 which includes mounting at least the lowermost riser form carrier in an anchoring unit and retaining the lowermost riser form carrier in position relative to the anchoring unit.

11. The method of claim 10 which includes using the anchoring unit to clamp at least two of the riser form carriers together.

12. The method of claim 10 which includes levelling the anchoring unit relative to the substrate.

13. The method of claim 9 which includes erecting formwork beneath the riser form carriers when the carriers are in the operative configuration.

14. The method of claim 13 which includes erecting the formwork on adjustable supports and adjusting the supports to adjust an angle at which the formwork is arranged relative to the riser forms.

* * * * *